US005096550A

United States Patent [19]

Mayer et al.

[11] Patent Number: 5,096,550

[45] Date of Patent: Mar. 17, 1992

[54] METHOD AND APPARATUS FOR SPATIALLY UNIFORM ELECTROPOLISHING AND ELECTROLYTIC ETCHING

[75] Inventors: Steven T. Mayer, Piedmont; Robert J. Contolini, Pleasanton; Anthony F. Bernhardt, Berkeley, all of Calif.

[73] Assignee: The United States of America as represented by the United States Department of Energy, Washington, D.C.

[21] Appl. No.: 597,225

[22] Filed: Oct. 15, 1990

[51] Int. Cl.[5] ..... C25F 3/02; C25F 3/16; C25F 7/00

[52] U.S. Cl. ..... 204/129.1; 204/129.25; 204/129.2; 204/212; 204/228; 204/231; 204/237; 204/238; 204/239; 204/240; 204/252; 204/DIG. 7

[58] Field of Search ..... 204/129.1, 129.65, 129.7, 204/212, 224 M, 231, 228, 252, 263-266, 237-238, 241, 273, 297 R, DIG. 7

[56] References Cited

U.S. PATENT DOCUMENTS

| | | | |
|---|---|---|---|
| 3,692,639 | 9/1972 | Delmousos | 204/DIG. 7 |
| 3,703,458 | 11/1972 | Read et al. | 204/252 X |
| 3,849,270 | 11/1974 | Takagi et al. | 204/129.1 |
| 4,073,708 | 2/1978 | Hicks, Jr. | 204/252 X |
| 4,238,310 | 12/1980 | Eckler et al. | 204/252 |
| 4,971,676 | 11/1990 | Doue et al. | 204/297 R |

OTHER PUBLICATIONS

"Electropolishing of Vertical Copper Cylinders in Phosphoric Acid Under Natural Convention Conditions" by G. H. Sedahmed et al., *Surface Technology*, 11, pp. 67-71 (1980).

"Electropolishing" article in *McGraw-Hill Encyclopedia of Science & Technology*, pp. 810-811 (1982).

*Primary Examiner*—Donald R. Valentine

*Attorney, Agent, or Firm*—Henry P. Sartorio; L. E. Carnahan; William R. Moser

[57] ABSTRACT

In an electropolishing or electrolytic etching apparatus the anode is separated from the cathode to prevent bubble transport to the anode and to produce a uniform current distribution at the anode by means of a solid nonconducting anode-cathode barrier. The anode extends into the top of the barrier and the cathode is outside the barrier. A virtual cathode hole formed in the bottom of the barrier below the level of the cathode permits current flow while preventing bubble transport. The anode is rotatable and oriented horizontally facing down. An extended anode is formed by mounting the workpiece in a holder which extends the electropolishing or etching area beyond the edge of the workpiece to reduce edge effects at the workpiece. A reference electrode controls cell voltage. Endpoint detection and current shut-off stop polishing. Spatially uniform polishing or etching can be rapidly performed.

42 Claims, 5 Drawing Sheets

METHOD AND APPARATUS FOR SPATIALLY UNIFORM ELECTROPOLISHING AND ELECTROLYTIC ETCHING

The United States Government has rights in this invention pursuant to Contract No. W-7405-ENG-48 between the U.S. Department of Energy and the University of California, for the operation of Lawrence Livermore National Laboratory.

BACKGROUND OF THE INVENTION

The invention relates generally to removal of metal in the formation of planarized interconnects for integrated circuits, and more particularly to method and apparatus for electro-removal, including generally electrochemical etching and particularly electropolishing.

Electropolishing is a method of polishing metal surfaces by applying an electric current through an electrolytic bath, as described for example in McGraw-Hill Encyclopedia of Science & Technology, pp. 810–811, 1982. The process is the reverse of electroplating. Anodic dissolution of surface features produces a flat, smooth, brilliant surface. Current density on the work surface is an important parameter. Below a certain voltage level, etching occurs. Above the etching voltage level, a constant current region is reached where polishing occurs. At even higher voltage, oxygen evolution interferes with polishing. The invention applies particularly to electropolishing, but can also be applied to electrolytic etching or electrochemical removal by varying the operating parameters from the polishing region.

In the fabrication of multilevel integrated circuit structures, the planarization of each metal layer, e.g., by pulsed laser or other heating as shown in U.S. Pat. Nos. 4,674,176 and 4,681,795 to Tuckerman, eliminates irregular and discontinuous conditions between successive layers, particularly where vias are located. To achieve fully planar multilevel interconnects, the dielectric layer must also be planarized, or the metal layer can be etched back so that it is flush with the dielectric layer.

U.S. Pat. No. 3,849,270 to Takagi et al. describes a process of manufacturing semiconductor devices using electrolytic etching to remove a coating layer from an insulating layer.

U.S. patent application Ser. No. 348,982 filed May 8, 1989, by Bernhardt et al. for Electrochemical Planarization describes a method and apparatus for forming a thin film planarized metal interconnect which is flush with the surrounding dielectric layer. In a preferred embodiment, a planarized metal layer is formed by controlled deposition, using an isotropic or other self-planarizing process, of a layer having a depth at least about half the width of the widest feature to be filled in the dielectric layer. The metal layer is then etched back by electropolishing.

In the electrochemical planarization process of U.S. patent application Ser. No. 348,982 filed May 8, 1989 is it essential that the etchback rate be substantially the same everywhere on the surface. The etchback process of preference is electropolishing because the etching rate can be high, the surface is polished (i.e. smoothed) in the process and the associated equipment is relatively inexpensive.

SUMMARY OF THE INVENTION

A primary object of the invention is to provide a spatially uniform polishing, etching or removal rate. To accomplish this, both edge effects and larger spatial non-uniformities are controlled. A second object of the invention is to polish the surface, that is, to reduce surface roughness at the same time as etching it. A third object of the invention is to remove material from the surface rapidly. Some advantages of the preferred embodiment are: 1) very high polishing rates (upwards of 1 μm/min) with excellent uniformity (about 1%; 2) a constant rate of removal after a short initial transient; and 3) easy end point detection. In electropolishing copper, for example, the etching or removal rate is limited by the formation of a dense layer. Controlling the diffusion of metal ions into the bulk of the polishing solution can significantly affect the etching or removal rate and its spatial uniformity.

The invention is a method and apparatus for electropolishing or otherwise electrolytically etching a sample or workpiece. The electropolishing apparatus or cell is formed of a containment vessel filled with electropolishing solution. The workpiece or sample is mounted in a holder, together forming an extended anode, which prevents edge effects at the workpiece. The sample is held in place on the sample holder by any suitable retaining means such as retaining clips. The inner portion of the sample holder is recessed to a depth equal to the sample thickness so that when the sample is placed into the sample holder, the outer portion (top surface) will be flush with the sample surface. The anode is typically rotatable, and is preferably oriented horizontally facing down, which results in high electropolishing rates. The anode is separated from the cathode to prevent bubble transport to the anode and to produce a uniform current distribution at the anode. For these purposes, a solid nonconducting anode-cathode barrier or cup is placed within the cell containment vessel. The anode extends into the top of the cup. The cathode is outside of the cup. A virtual cathode hole is formed in the bottom of the cup, below the level of the cathode, permitting current flow while preventing bubble transport to the anode. Heat removal may be performed either internal or external to the cell. A reference electrode can be used to control cell voltage. End point detection and current shutoff can be used to stop polishing at the desired point. By etching so that the edge clears first, the change in reflectance or color of an underlying adhesion layer can be detected, or electrical contact can be broken.

DETAILED DESCRIPTION OF THE PREFERRED EMBODIMENTS

Figure 1A:
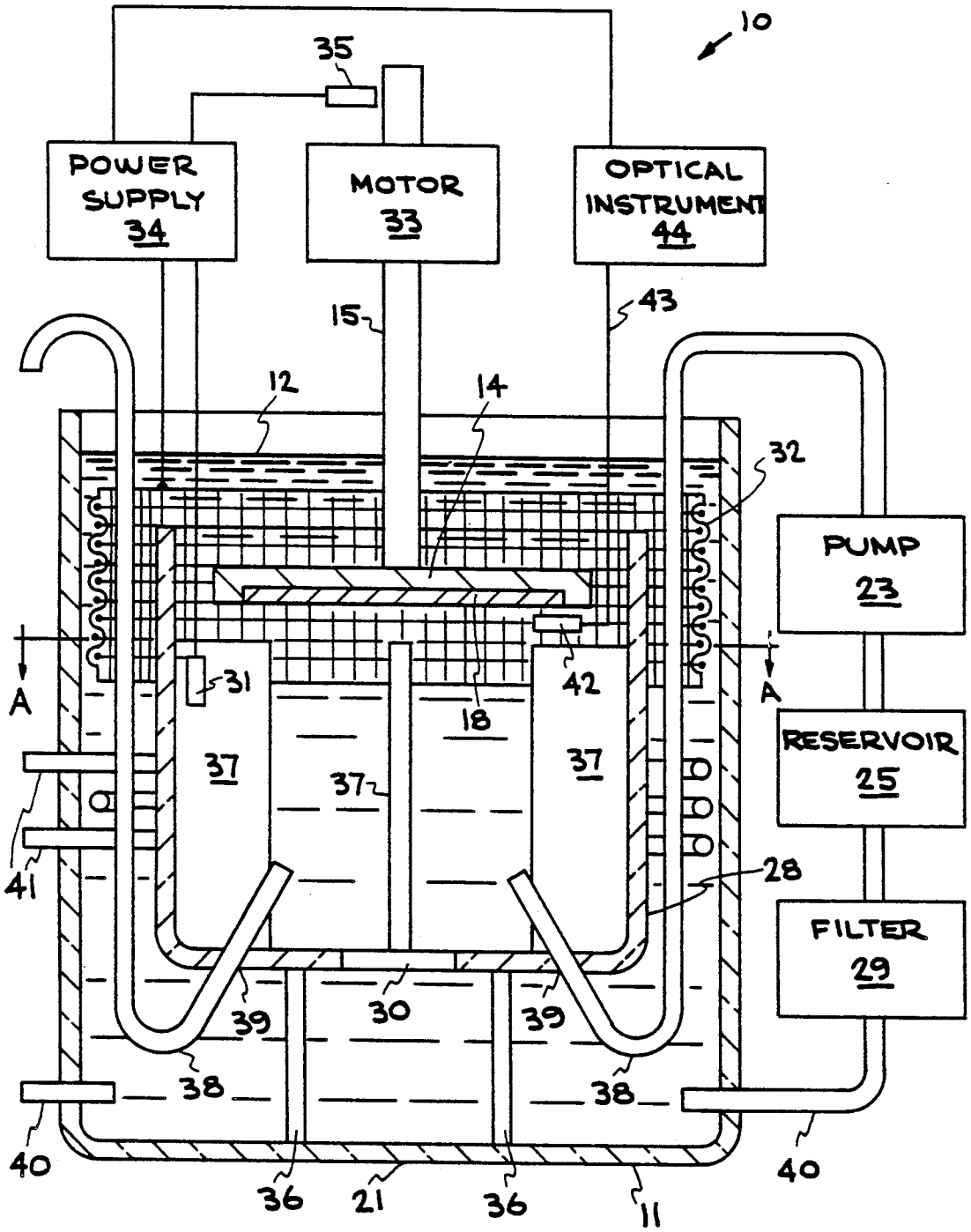
FIG. 1A is a perspective view of an electropolishing apparatus according to the invention.

An electropolishing apparatus (cell) 10 according to the invention is shown in FIGS. 1A, B. Cell 10 is formed of a containment vessel or tank (cell body) 11 filled with electropolishing solution 12. The invention is primarily described in terms of electropolishing; however, the method and apparatus can also be used for electrochemical etching (electro-removal) in general. Therefore, a reference to polishing may also be interpreted as etching or removal, except where clearly limited from the context.

For illustrative purposes, the polishing of copper using the apparatus of FIGS. 1A, B is described. For copper an electropolishing solution is composed of phosphoric acid which contains a fraction of water which can be adjusted to optimize the electropolishing rate with respect to other polishing properties such as surface smoothness. For other materials the solution might be different, e.g., hydrochloric acid in glycerine can be used for electropolishing gold. Other solutions can also be used for copper. Important physical properties of the solution are its viscosity and its electrical conductivity.

Figure 2:
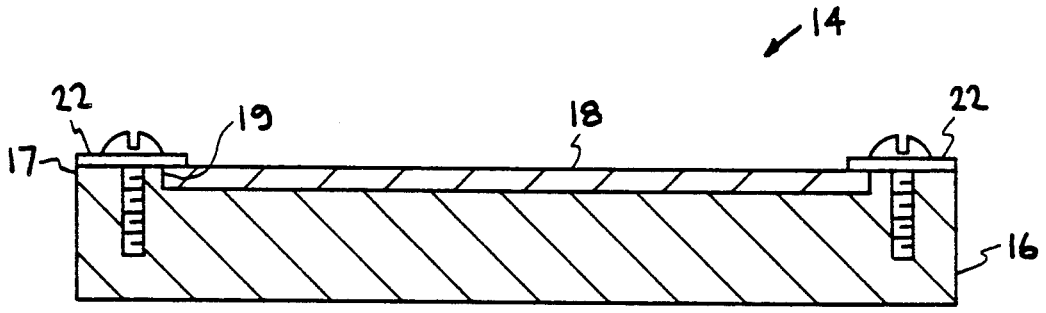
FIG. 2 is a perspective and assembly view of the extended anode.

The sample to be polished (the "workpiece" or anode) is mounted into a holder, with which it forms an extended anode 14, in the sense that the surface of the holder nearest to the workpiece is made of the material to be electropolished, in this example copper, and is electropolished along with the workpiece. A particular embodiment of the extended anode is shown in FIG. 2. The extended anode 14 is formed of a copper wafer holder 16 on which the workpiece or sample (e.g., wafer) 18 is held. The sample 18 is held in place by retaining means such as clips 22, which are preferably made of the material being polished. Holder 16 has an outer portion 17 and a recessed inner region 19. Sample 18 fits into region 19 so that the upper surface of sample 18 is flush with the upper surface of outer portion 17, thereby extending the anode surface. Although holder 16 is typically circular in shape, noncircular samples 18 can be held by forming the recessed region 19 of suitable shape.

This extended anode arrangement removes edge or loading effects from the edge of the workpiece to the surface of the holder. (At the boundary between the polishable material and inert surfaces, or at physical edges, polishable material near the edge is removed faster than the polishable material far from the edge.) By varying the size of the border of polishable material on the holder, it is possible to control the electropolishing rate at the edge of the workpiece with respect to that at interior regions. One can simply make these rates substantially equal or one can let the workpiece edge polish controllably faster for some purpose such as end point detection, as described herein. In addition, by varying the flow rate of electrolyte impinging on the center of the sample, the rate at the center can be increased with respect to that at the edge.

Anode 14 is attached to a shaft 15 of FIG. 1A so that the anode 14 can be rotated by means of motor 33. In the apparatus of FIG. 1A, the anode 14 is positioned horizontally with the workpiece surface facing downward in the Earth's gravitational field. This arrangement has the advantage that the "copper phosphate" layer which forms during electropolishing at the anode surface, being more dense than the bulk of the electropolishing solution, can fall away from that surface and redissolve more quickly than if the anode surface had another orientation (as, for example, shown in the apparatus of Ser. No. 348,982 filed May 8, 1989). This allows higher polishing rates than for other orientations, other parameters such as rotation speed being equal.

Another advantage of the inverted anode orientation is the uniformity of polishing rate over the sample (compared, for example, to a vertical anode orientation, in which gravity draws the dense layer across the surface from top to bottom). The preferred embodiment draws upon the concepts associated with a rotating disk electrode (RDE), often used in theoretical studies of kinetics and mass transfer in electrochemical systems. Solutions of the momentum and mass transport of the RDE system are well-known (e.g. J. Newmann, Electrochemical Systems, Prentice-Hall, Englewood N.J., 1973), and demonstrate that under certain conditions, the current distribution to the disk will be uniform. It is, however, essential to provide substantially uniform primary current distribution at the anode.

A third advantage of this "face-down" arrangement is the ease with which the workpiece can be placed into and removed from the holder. This accessibility is essential for automation of the process. There are, however, several problems associated with the face-down arrangement, as well as other alternative arrangements, which the invention recognizes and addresses.

Figure 1B:
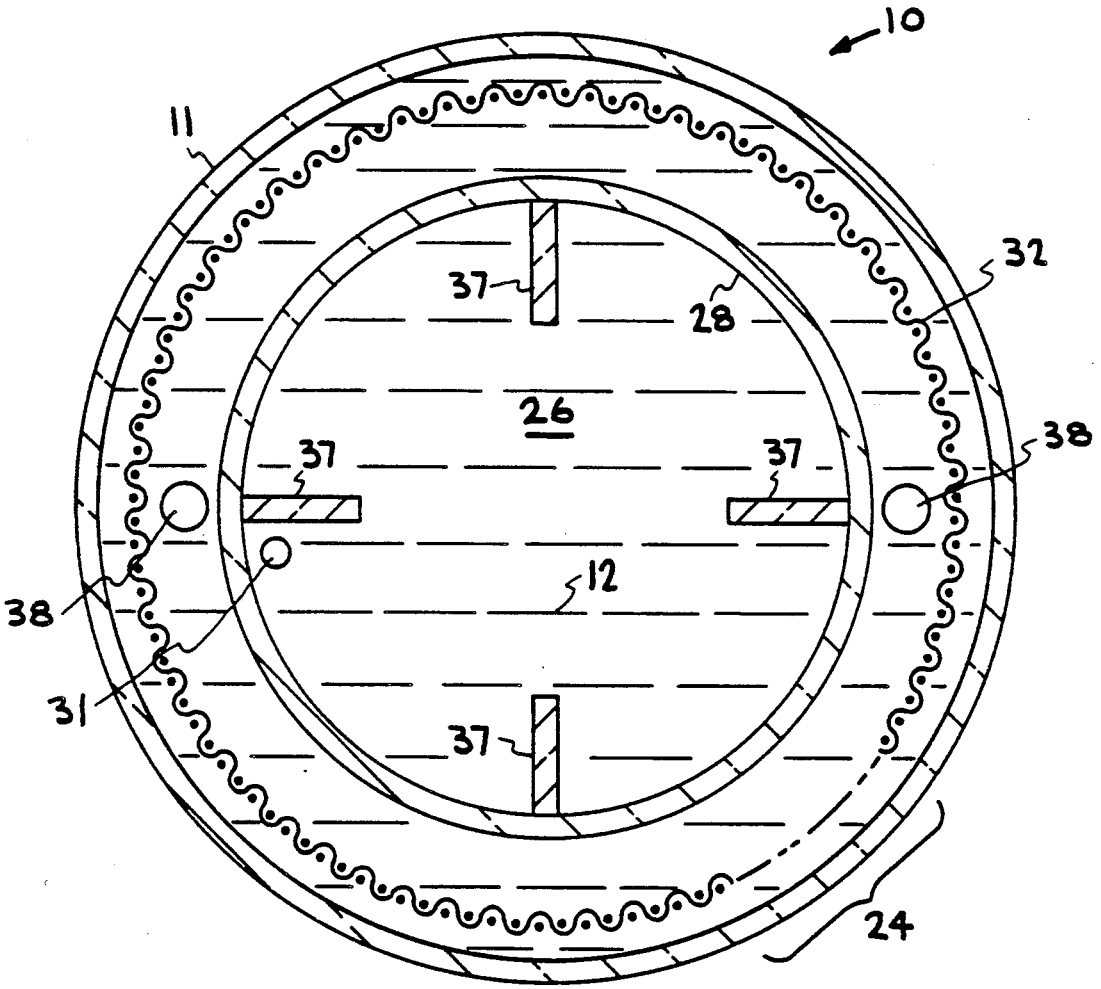
FIG. 1B is a horizontal cross-sectional view taken along line A—A of FIG. 1A.

The first problem is that bubbles formed at the cathode or otherwise introduced into the solution can migrate (rise in the vertical arrangement) and settle on the anode surface. These bubbles will cause local nonuniformities in the anode surface (e.g., unpolished or overpolished spots). To address this problem, the apparatus of FIGS. 1A, B introduces a separation means or barrier between the cathode and the anode through which electrical current can pass, but bubbles cannot. This is accomplished by means of a non-conducting solid barrier (chamber or cup) 28 with a hole or aperture 30 in the bottom. Cathode 32, e.g., a screen, is positioned at the top of the containment vessel 11 external to the anode-cathode barrier 28 and extends, at least partially, around the anode-cathode barrier 28. As shown in FIG. 1B, cathode 32 extends entirely around the inside surface of tank 11, but a portion, e.g., section 24, can be omitted to permit better visual observation of the anode. Anode 14 extends into barrier 28, which defines an anode chamber volume 26 therein. Current can pass through hole 30, but, since the hole 30 is below the level of the cathode 32, no bubbles pass through it and enter the anode chamber volume 26. Instead, bubbles generated by the cathode rise to the surface of the solution over the cathode 32.

As shown in FIG. 1A, anode 14 and cathode 32 are electrically connected to a voltage source or power supply 34 (the connection to anode 14 is shown through shaft 15, e.g., by an electrical brush 35). Suitable electrical connection to the workpiece can be made through the anode holder 16, e.g., through clips 22, shown in FIG. 2. Voltage source 34 provides the necessary voltage-current to produce polishing; otherwise, etching will occur. The anode-cathode barrier cup 28 sits on legs 36 above the bottom 21 of containment vessel 11. A reference electrode 31 is immersed in the solution inside the anode-cathode barrier cup 28. Fluid inlets 38 extend into the cell body 11 and through holes 39 in the bottom of cup 28 to inject or remove solution 12 in the interior of cup 28 near anode 14. Fluid outlets 40 also extend into cell body 11 outside cup 28, and act as an inlet or outlet of solution 12 for the cell. Generally, solution is injected into the anode-cathode barrier cup 28 to alter the relative polishing rate uniformity, and is removed from the chamber for filtration purposes. Inlets 38 and outlets 40 can be used to continuously or otherwise recirculate solution 12 through the cell. For example, solution removed through an outlet 40 may be filtered by filter 29, then placed in reservoir 25, from which it is pumped by pump 23 through inlet 38 into chamber 28. Filter 29 can also be combined with or replaced by a cooling chamber, as further described herein.

A constantly rotating anode (particularly in the face down orientation) tends to generate a wavy surface, analogous to the "accordion instability" which produces periodic humps in roads travelled by heavy trucks. This phenomena can be reduced by minimizing the rotation of the fluid which will naturally arise in the anode-cathode barrier cup compartment by either: 1) adding fluid with no rotational inertia into the chamber, along the natural flow lines which impinge on the anode 14 (as accomplished by fluid inlets 38); or 2) adding baffles 37 to the bath whose size and shape minimize the tendency of the fluid to spin in the chamber, but do not significantly alter the overall primary current distribution. Experimentally, it has been determined that these baffles can extend from the wall of the anode-cathode barrier cup toward the center of the cup to the virtual cathode hole 30, thereby completely eliminating spiral formation without altering the current distribution.

Figure 3:
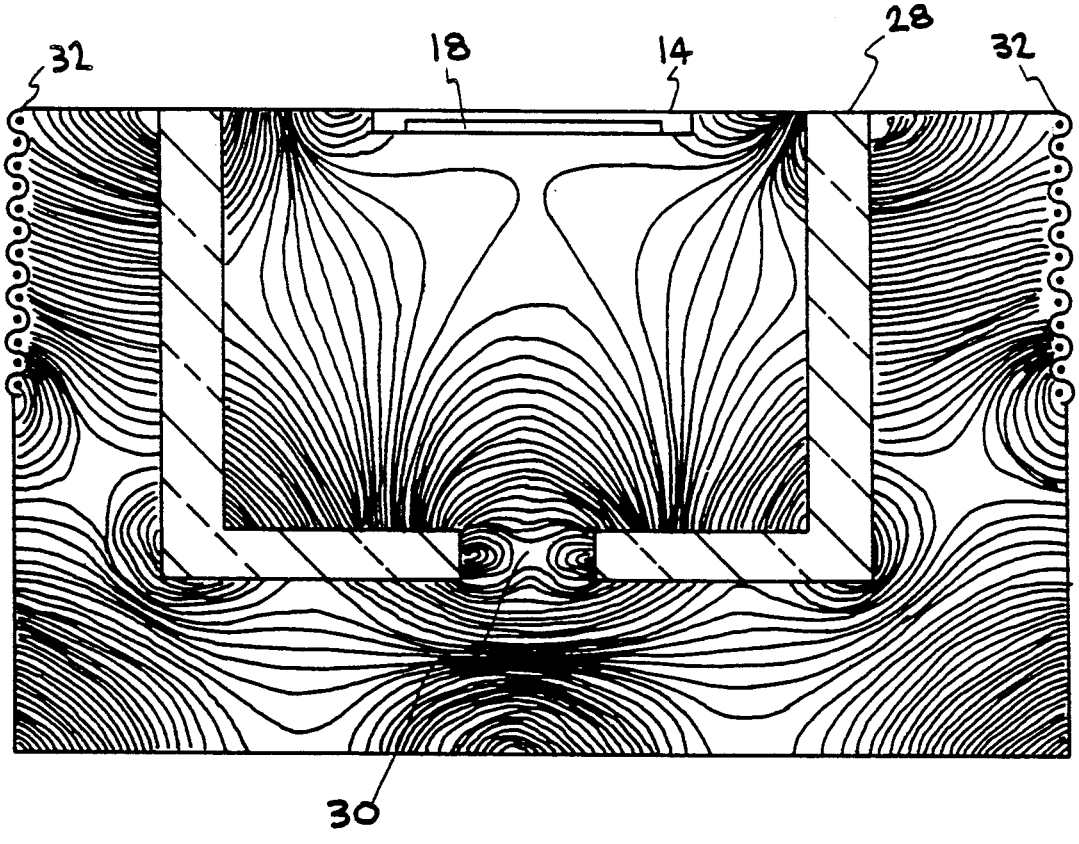
FIG. 3 is a diagram showing the calculated primary current distribution within the electropolishing apparatus.

The material of the anode-cathode cup also serves as a barrier to the flow of charge. The hole in the bottom of the cup functions as a virtual cathode in the sense that all the current must pass through the hole. The primary current distribution at the anode is strongly influenced by the dimensions of the hole and is important in achieving the desired uniformity of polishing rate at the anode, as shown in FIG. 3. A graph of the primary current distribution through the diameter of a vertical cross-section of cell 10 with a particular set of geometric parameters is shown in FIG. 3. The displayed contour lines are of constant current flux. Adjacent lines are separated by regions in which the flux differs by 5%. The sample 18 (inside extended anode 14) is wholly within a 5% region. Generally, the diameter of the hole must be smaller than the workpiece and it must be separated from the anode by a distance larger than the largest anode dimension. However, the hole must not be so small as to cause charge crowding near its edge (thereby significantly increasing the overall cell resistance), nor so large that the distance from the edge of the hole to the edge of the anode is significantly smaller than that from the edge of the hole to the center of the anode. Dimensions can be optimized by calculating the primary current distribution to maximize the desired level of current uniformity. The actual current distribution will be best when the primary (ohmic), secondary (kinetic), and tertiary (diffusion controlled) current distributions are all substantially uniform.

Because a significant amount of heat is generated inside the apparatus, the temperature of the cell will rise during its use if means for the removal of this heat are not available. Generally, the rate and operating voltage of electropolishing are changed by the cell temperature. Therefore, to maintain a controlled electropolishing rate, it is necessary to install a heat exchange mechanism for this system. Two possible embodiments are to have cooling coils 41 inside the bath, as shown in FIG. 1A, or to cool the electrolyte externally of the cell, e.g., combining or replacing the filtration line with a cooling chamber 29 or cooling the reservoir 25.

It is also preferred that the voltage of the cell be controlled by a "three electrode system". In such a system, the voltage of the anode is set and maintained with respect to an unpolarized reference electrode 31 of FIG. 1A (i.e., an electrode through which no d.c. current passes), but the anode surface voltage is driven by varying the potential of the cathode. Such a system ensures the electrochemical stability of the anode interface from being thrown into a potential regime where unwanted side reactions occur (e.g., oxygen evolution at the anode), as well as provides a controlled approach to surface film formation and steady state electropolishing.

It is another object of the apparatus to provide for end point detection and current shut-off. It is desirable to leave a small amount of copper on the workpiece because the polishing rate for isolated structures (such as embedded lines) can be much greater than for a surface completely covered with the metal being polished. If the metal of the unpatterned areas is permitted to clear, the embedded, planarized features will be etched more than desired. One method of detecting when the unpatterned areas are about to clear is to observe a change in the reflectivity of the surface near the edge of the sample. If slightly less material is deposited at the edge of the sample or the polishing rate is slightly greater at the edge, then the metal will clear there first. In one preferred embodiment, an adhesion layer (e.g., of Cr or Ti) is sputtered onto a silicon or silicon oxide substrate. After the sputtering of a thin "seed" layer of copper metal onto this adhesion layer, copper is electroplated onto the substrate. When the copper is finally polished away at the edge, this adhesion layer is exposed. Since the adhesion layer is silver or "metallic" in color, it is easily distinguishable from copper. The adhesion layer is not substantially attacked by the electropolishing process. A difference in the reflectivity or color of the substrate with respect to that of the material being polished can therefore be observed and the current shut off. For example, a suitable optical instrument can be use to observe this change and automatically shut the current off. As shown in FIG. 1A, fiber optic probe 42 can be set nearby and facing the portion of the anode which clears first and an appropriate optical instrument 44 is placed on the other end of the fiber optic 43 to detect the reflectivity change. Instrument 44 is electrically connected to power supply 34 to shut off the current. In a preferred embodiment, the barrier cup and the containment vessel are made of glass, and there is a separation in the cathode so that the anode can be viewed from outside the apparatus.

Figure 4A:
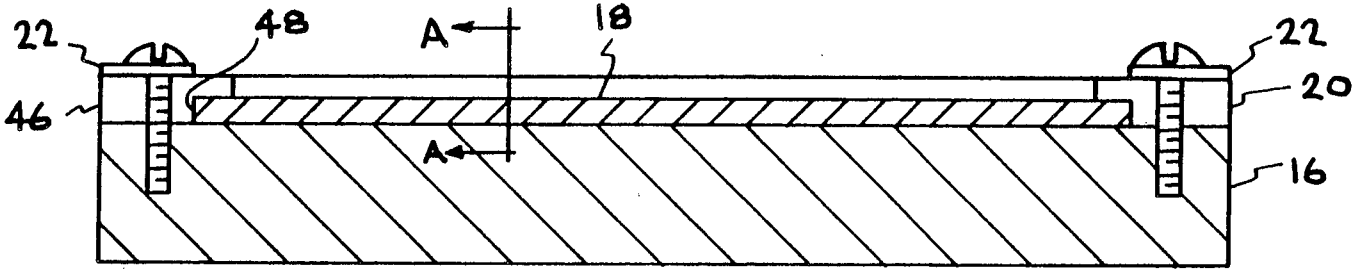
FIG. 4A is a perspective assembly view of a sample with end point ring.
Figure 4B:
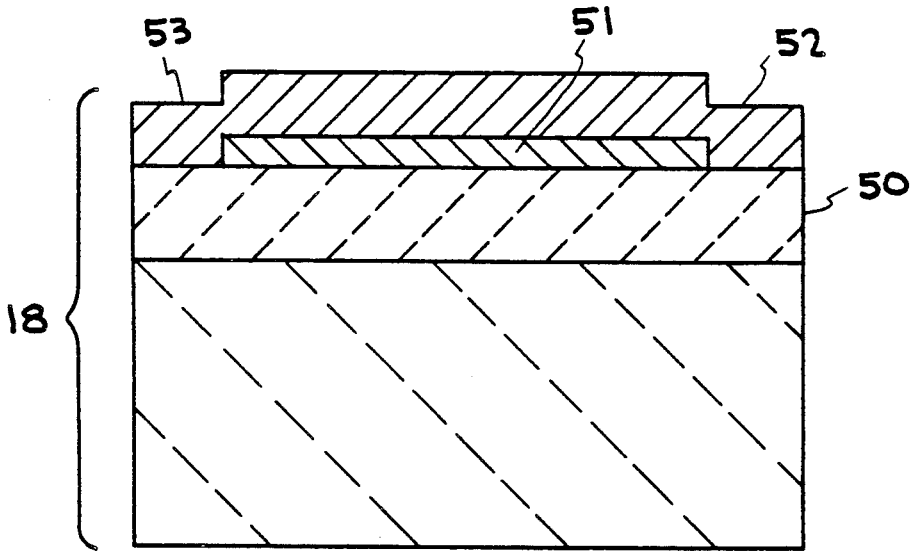
FIG. 4B is a vertical cross-sectional view of the sample taken along line A—A of FIG. 4A.

The functions of the end point detector and the automatic current shut-off can be combined. If the connection between the sample and the power supply is through the metal being polished and is located near the edge of the sample, then by making the metal at the edge clear first, the current path to the sample is also severed. An embodiment of such an arrangement is illustrated in FIGS. 4A, B. Preferably, a "retaining" ring 20 is placed over the workpiece 18 and both are held on holder 16 by retaining clips 22 through which anode current is provided to the sample 18, in order to provide more uniform electrical contact to the sample, as shown in FIG. 4A. Retaining ring 20 is formed of an outer portion 46 and a recessed inner portion 48. Sample 18 fits into recessed portion 48. A detailed illustrative workpiece structure is shown in FIG. 4B. The penultimate layer 50 of the substrate (workpiece 18) is an insulator (e.g., undoped Si or $SiO_2$) onto which an adhesion layer 51 is added (e.g., by sputtering) everywhere except near the edge. Next, a seed layer 52 of the metal to be polished is added. During electropolishing, the edges clear first, and since the electrical contacts are made at the edge, the current path is severed before the center of the sample clears. For example, the edge portion 53 is etched down to insulating layer 50 before the rest of metal layer 52 is etched away. Since electrical contact to metal layer 52 is through edge portion 53, polishing stops when edge portion 53 has been totally etched away. Electrical contact is maintained with the edge portion by suitable clips or other contacts, which stay in contact while the layer is being etched away. Inner portion 48 of ring 20 contacts workpiece 18 at the edge of edge portion 53, with outer portion 46 extending out from workpiece 18 and down to holder 16. The part of edge portion 53 not covered by inner portion 46 will etch down to layer 50 and thus break electrical contact to the interior of layer 52.

In an illustrative embodiment, the tank is 16" in diameter and 9½" high. The barrier cup is 6½" high, has an inside diameter of 9¼", and an outside diameter of 10". The cup thus sits 3" above the bottom of the tank. Both are made of glass. The virtual cathode hole is 2" in diameter. The workpiece is 4" in diameter and the extended anode is 6" in diameter so there is a 1" sacrificial edge around the workpiece. The cathode screen is 4" high and extends from the top of the tank. The anode is near the top of the tank.

Changes and modifications in the specifically described embodiments can be carried out without departing from the scope of the invention which is intended to be limited only by the scope of the appended claims.

We claim:

1. An apparatus for electropolishing and electrolytically etching a workpiece, comprising:
- a containment vessel for containing electrolytic solution;
- a cathode mounted in the containment vessel;
- a substantially flat anode containing the workpiece positioned in the containment vessel;
- means to rotate the anode in the containment vessel;
- separation means positioned between the anode and cathode for preventing bubble transport from the cathode to the anode and for the passing electric current between the cathode and anode.

2. The apparatus of claim 1 wherein the separation means comprises a means for producing substantially uniform current distribution at the anode.

3. The apparatus of claim 1 wherein the separation means comprises a solid nonconducting barrier with a virtual cathode aperture formed therein.

4. The apparatus of claim 3 wherein the barrier is a chamber surrounding the anode and having a base spaced apart from the bottom of the containment vessel and the aperture is formed in the base.

5. The apparatus of claim 4 further comprising a plurality of baffles positioned in the chamber around the aperture to reduce fluid rotation in the chamber when the anode is rotated.

6. The apparatus of claim 4 wherein the aperture has a largest dimension less than the largest dimension of the anode, is separated from the anode by a distance larger than the largest anode dimension, and is sufficiently large to prevent charge crowding near its edge.

7. The apparatus of claim 4 wherein the aperture has a largest dimension and is separated from the anode such that the distance from the aperture edge to the edge of the anode is substantially the same as the distance of the center of the anode.

8. The apparatus of claim 1 wherein the anode comprises a holder and means for retaining the workpiece thereon.

9. The apparatus of claim 1 wherein the anode is an extended anode having a sacrificial edge extending beyond the edge of the workpiece to remove edge effects from the workpiece.

10. The apparatus of claim 1 wherein the anode is positioned in a horizontal facedown orientation in the containment vessel.

11. The apparatus of claim 1 further comprising a power supply electrically connected to the anode and cathode.

12. The apparatus of claim 1 further comprising fluid inlets and outlets for directing electrolytic solution into and out of the containment vessel.

13. The apparatus of claim 12 further comprising recirculation means connected between the fluid inlets and outlets.

14. The apparatus of claim 13 wherein the recirculation means further comprises filtering means.

15. The apparatus of claim 13 wherein the recirculation means further comprises cooling means.

16. The apparatus of claim 1 further comprising cooling means in the containment vessel.

17. An apparatus for electropolishing and electrolytically etching a workpiece, comprising;
- a containment vessel for containing electrolytic solution;
- a cathode mounted in the containment vessel;
- a substantially flat anode containing the workpiece positioned in the containment vessel;
- separation means positioned between the anode and cathode for preventing bubble transport from the cathode to the anode and for passing electric current between the cathode and anode;
- wherein the anode comprises a holder and means for retaining the workpiece thereon;
- wherein the holder comprises an outer portion and an inner recessed region wherein the workpiece fits within the recessed region with its top surface substantially flush with the top surface of the outer portion.

18. The apparatus of claim 17 wherein the outer portion of the holder is formed of the same material as the workpiece to extend the anode surface to remove edge effects from the workpiece.

19. The apparatus of claim 17 further comprising means to rotate the anode in the containment vessel.

20. An apparatus for electropolishing and electrolytically etching a workpiece, comprising:
- a containment vessel for containing electrolytic solution;
- a cathode mounted in the containment vessel;
- a substantially flat anode containing the workpiece positioned in the containment vessel;
- separation means positioned between the anode and cathode for preventing bubble transport from the cathode to the anode and for passing electric current between the cathode and anode;

a power supply electrically connected to the anode and cathode;

a reference electrode positioned in the containment vessel and connected to the power supply to maintain stability of anode voltage.

21. An apparatus for electropolishing and electrolytically etching a workpiece, comprising:

a containment vessel for containing electrolytic solution;

a cathode mounted in the containment vessel;

a substantially flat anode containing the workpiece positioned in the containment vessel;

separation means positioned between the anode and cathode for preventing bubble transport from the cathode to the anode and for passing electric current between the cathode and anode;

fluid inlets and outlets for directing electrolytic solution into and out of the containment vessel;

wherein the fluid inlets are positioned to direct electrolytic solution against the anode.

22. An apparatus for electropolishing and electrolytically etching a workpiece, comprising:

a containment vessel for containing electrolytic solution;

a cathode mounted in the containment vessel;

a substantially flat anode containing the workpiece positioned in the containment vessel;

separation means positioned between the anode and cathode for preventing bubble transport from the cathode to the anode and for passing electric current between the cathode and anode;

endpoint detection means for shutting off anode current when polishing or etching is completed.

23. A method for electropolishing and electrolytically etching a workpiece, comprising:

electrically connecting the workpiece to a substantially flat anode of a voltage source;

placing the anode and a cathode in an electrolytic solution;

rotating the anode;

flowing a current of sufficient density through the anode to electropolish or electrolytically etch the workpiece;

separating the anode from the cathode by separation means which prevent bubble transport from the cathode to the anode and pass electric current between the cathode and anode, the separation means being configured to produce substantially uniform current distribution at the anode.

24. The method of claim 23 wherein the step of separating comprises surrounding the anode by a solid nonconducting barrier having a virtual cathode aperture formed therein.

25. The method of claim 24 wherein the aperture has a largest dimension less than the largest dimension of the anode, is separated from the anode by a distance larger than the largest anode dimension, and is sufficiently large to prevent charge crowding near its edge.

26. The method of claim 24 wherein the aperture has a diameter such that the distance from the aperture edge to the edge of the anode is substantially the same as the distance to the center of the anode.

27. The method of claim 23 further comprising forming the anode as an extended anode having a sacrificial edge extending beyond the edge of the workpiece to remove edge effects from the workpiece.

28. The method of claim 23 further comprising positioning the anode in a horizontal face down orientation in the electrolytic solution.

29. The method of claim 23 further comprising placing a reference electrode in the electrolytic solution and connecting the reference electrode to the voltage source to maintain a stabilized voltage at the anode.

30. The method of claim 23 further comprising directing electrolytic solution against the anode.

31. The method of claim 23 further comprising cooling the electrolytic solution.

32. A method for electropolishing and electrolytically etching a workpiece, comprising:

electrically connecting the workpiece to a substantially flat anode of a voltage source;

forming the anode of a holder and means for retaining the workpiece thereon;

placing the anode and a cathode in an electrolytic solution;

flowing a current of sufficient density through the anode to electropolish or electrolytically etch the workpiece;

separating the anode from the cathode by separation means which prevent bubble transport from the cathode to the anode and pass electric current between the cathode and anode, the separation means being configured to produce substantially uniform current distribution at the anode.

33. The method of claim 32 further comprising forming the holder with an outer portion and an inner recessed region wherein the workpiece fits within the recessed region with its top surface substantially flush with the top surface of the outer portion.

34. The method of claim 33 wherein the outer portion of the holder is formed of the same material as the workpiece to extend the anode surface to remove edge effects from the workpiece.

35. The method of claim 32 further comprising rotating the anode.

36. The method of claim 35 further comprising reducing rotation of the electrolytic solution by positioning baffles within the separation means.

37. A method for electropolishing and electrolytically etching a workpiece, comprising:

electrically connecting the workpiece to a substantially flat anode of a voltage source;

placing the anode and a cathode in an electrolytic solution;

flowing a current of sufficient density through the anode to electropolish or electrolytically etch the workpiece;

separating the anode from the cathode by separation means which prevent bubble transport from the cathode to the anode and pass electric current between the cathode and anode, the separation means being configured to produce substantially uniform current distribution at the anode;

recirculating and filtering the electrolytic solution.

38. A method for electropolishing and electrolytically etching a workpiece, comprising:

electrically connecting the workpiece to a substantially flat anode of a voltage source;

placing the anode and a cathode in an electrolytic solution;

flowing a current of sufficient density through the anode to electropolish or electrolytically etch the workpiece;

separating the anode from the cathode by separation means which prevent bubble transport from the cathode to the anode and pass electric current between the cathode and anode, the separation means being configured to produce substantially uniform current distribution at the anode;

detecting an endpoint on the workpiece that has been completely electropolished or etched and shutting off anode current when the endpoint is detected.

39. Apparatus for electropolishing/electrolytic etching a workpiece, comprising:

a containment vessel;

a cathode mounted in the vessel;

an extended anode positioned horizontally face down in the vessel and having the workpiece mounted thereon, with a sacrificial polishable/etchable border of the same material as the workpiece surrounding and flush with the workpiece;

a voltage source electrically connected to the anode and cathode;

an electropolishing/etching solution filling the vessel;

means for rotating the anode connected thereto;

a solid nonconducting barrier surrounding the anode and separating the anode from the cathode, the barrier extending below the level of the cathode to prevent bubble transport from the cathode to the anode and having a base raised from the bottom of the vessel and containing a virtual cathode aperture in the base which allows current flow from the cathode to the anode, the barrier and aperture being configured to provide substantially uniform current distribution at the anode;

a reference electrode positioned in the barrier and electrically connected to the voltage source to maintain a stabilized anode voltage;

solution inlet/outlet means extending into the vessel and into the barrier;

vertical baffles mounted in the barrier extending radially around the virtual cathode aperture.

40. In an electropolishing/electrolytic etching apparatus, an extended anode comprising a workpiece and a workpiece holder, the holder comprising an outer portion made of the same material as the workpiece and an inner recessed region, wherein the workpiece fits within the recessed region with its top surface substantially flush with the top surface of the outer portion.

41. An apparatus for electropolishing and electrolytically etching a workpiece, comprising:

a containment vessel for containing electrolytic solution;

a cathode mounted in the containment vessel;

a substantially flat anode containing the workpiece positioned in the containment vessel;

a solid nonconducting barrier surrounding the anode and positioned between the anode and cathode for preventing bubble transport from the cathode to the anode, the barrier having a base spaced apart from the bottom of the containment vessel and a virtual cathode aperture formed in the base for passing electric current between the cathode and anode;

wherein the aperture has a largest dimension less than the largest dimension of the anode, is separated from the anode by a distance larger than the largest anode dimension, and is sufficiently large to prevent charge crowding near its edge.

42. The apparatus of claim 41 wherein the anode and cathode are both mounted in the containment vessel above the virtual cathode aperture.

* * * * *